United States Patent [19]

Matsui et al.

[11] Patent Number: 4,482,894

[45] Date of Patent: Nov. 13, 1984

[54] CONTROL CIRCUIT FOR A SEGMENTED DISPLAY DEVICE

[75] Inventors: Kohichi Matsui; Kowji Tanikawa, both of Tokyo, Japan

[73] Assignee: Olympus Optical Co., Ltd., Tokyo, Japan

[21] Appl. No.: 312,257

[22] Filed: Oct. 13, 1981

[30] Foreign Application Priority Data

Oct. 29, 1980 [JP] Japan ..... 55-151898

[51] Int. Cl.[3] ..... G09G 3/14

[52] U.S. Cl. ..... 340/756; 340/762; 340/802; 178/30

[58] Field of Search ..... 340/762, 756, 782, 766, 340/802; 178/30

[56] References Cited

U.S. PATENT DOCUMENTS

| | | | |
|---|---|---|---|
| 3,444,319 | 5/1969 | Artzt et al. | 178/30 |
| 4,005,404 | 1/1977 | Soobik | 340/762 |
| 4,075,621 | 2/1978 | Salmon | 340/762 |
| 4,122,395 | 10/1978 | Schotz et al. | 340/762 |

*Primary Examiner*—Marshall M. Curtis

[57] ABSTRACT

A display device which comprises a keyboard for specifying a character to be displayed, a decoder for converting a specified character signal into segment signals corresponding to light emitting segments, and a display section which is provided with a plurality of segment display elements, and which are so arranged as to emit light in accordance with the contents of the segment signals. In this display device, a ROM converts a signal representing a character specified by the keyboard into at least two character component signals corresponding to at least two character components of the specified character and the converted character component signals are supplied to the decoder.

4 Claims, 4 Drawing Figures

CONTROL CIRCUIT FOR A SEGMENTED DISPLAY DEVICE

BACKGROUND OF THE INVENTION

This invention relates to a segment type character display device.

Recently various forms of control are carried out by a one-chip microcomputer. In this case, a display device whose digit divisions are each provided with 7-segment light emitting diodes (LEDS) to indicate the results of an arithmetic operation in the form of numerals is connected to the one-chip microcomputer. Where not only numerals, but also alphabet letters and notations are displayed 9-segment or 16-segment LEDS are used. An increase in the number of the segments of each digit division of the display device or the forms of characters to be displayed naturally results in having to enlarge the capacity of a decoder for converting a character signal into a segment signal. Since, however, the one-chip microcomputer is often already provided with a decoder, an increase in the decoder capacity is objectionable.

SUMMARY OF THE INVENTION

It is accordingly the object of this invention to provide a display device capable of indicating a large variety of characters by applying a small capacity decoder.

To attain the above-mentioned object, this invention provides a display device which comprises a signal generator for issuing a signal corresponding to a character to be displayed, a circuit for converting an output character signal from the signal generator into at least two signals corresponding to at least two character components constituting the character represented by the output character signal, and a display section including a plurality of segment display elements which are selectively illuminated according to the output signals from the circuit.

DETAILED DESCRIPTION OF THE PREFERRED EMBODIMENT

Figure 1:
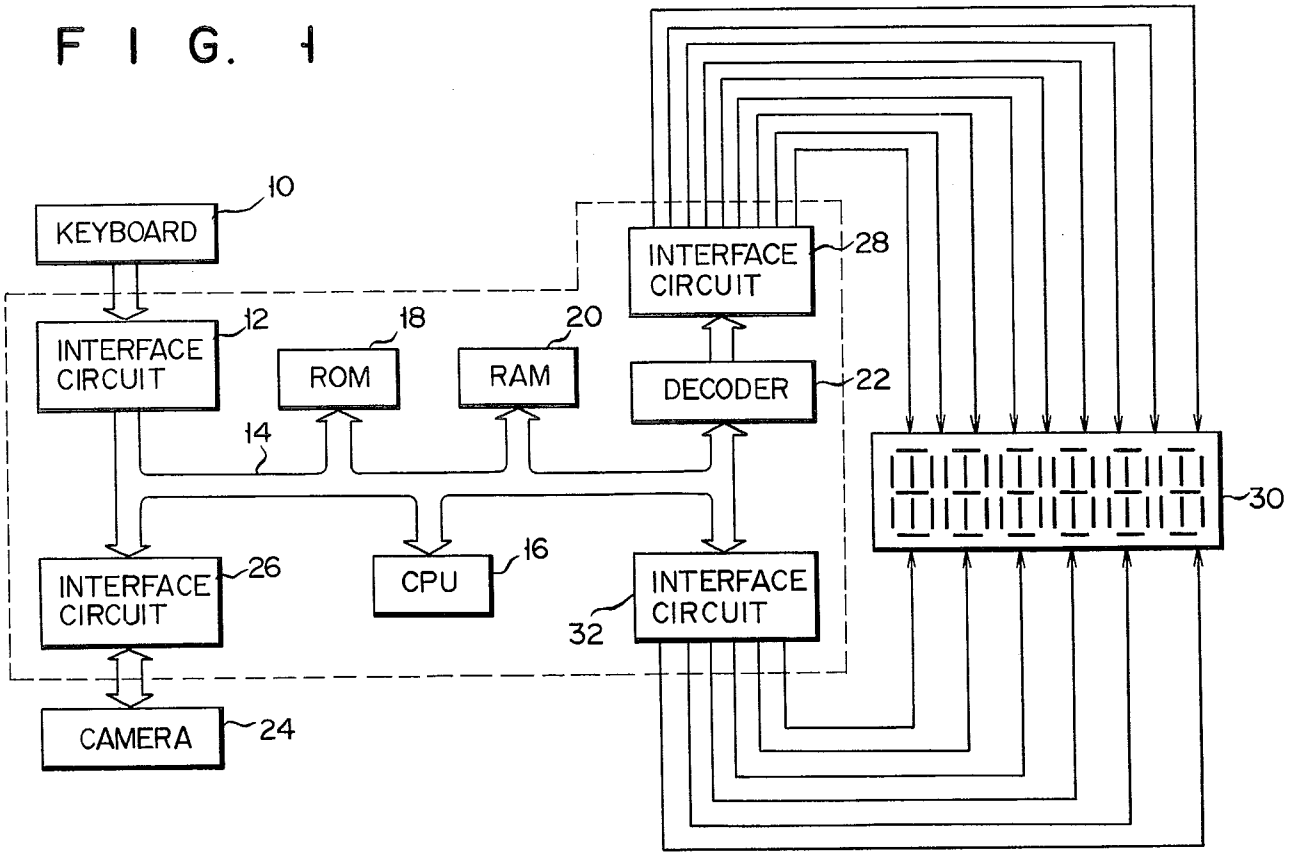
FIG. 1 is a block circuit of an embodiment of a display device according to this invention.

Description is now given with reference to the accompanying drawings of a display device embodying this invention. FIG. 1 is a block circuit diagram of the display device. Now let it be assumed that the subject display device is applied to a data-impressing camera. In this case, a keyboard 10 is connected to a central processor unit (CPU) 16 through an interface circuit 12 and a bus line 14. The bus line 14 is further connected to a read only memory (ROM) 18, random access memory (RAM) 20 and decoder 22. A camera 24 is connected to the bus line 14 through an interface circuit 26. An output signal from the decoder 22 is supplied to a display section 30 through an interface circuit 28. The display section 30 is formed of six digit divisions, each of which consists of 9-segment LEDs. All LEDs of each digit division are connected at one end, (for example, anode) to corresponding digit division electrodes. The LEDs of the same segments of the respective digit divisions are connected at the other end (for example, cathode) to corresponding segment electrodes. With a display device embodying this invention, the decoder 22 has nine output terminals. An output signal from each output terminal is supplied to the corresponding segment electrode of the display section 30. An output signal from each output terminal of an interface circuit 32 connected to the bus line 14 is supplied to the corresponding digit division electrode of the display section 30. A broken line block given in FIG. 1 corresponds to a one-chip microcomputer.

Description is now given of the operation of the display device embodying this invention. Data to be impressed on a photograph are previously specified by operating the keyboard 10. The specified character data are stored in the RAM 20. When data are changed from one film frame to another, then the serial numbers of the film frames are also specified by operating the keyboard 10 and stored in the RAM 20. The display section 30 is so positioned that light emitted therefrom is projected on a film frame. The photographing operation including film exposure and data impressing, etc. is carried out in accordance with a program stored in the ROM 18 under control of the CPU 16. A character signal is read out from the ROM 20 in synchronization with the shutter release of the camera.

Figure 2:
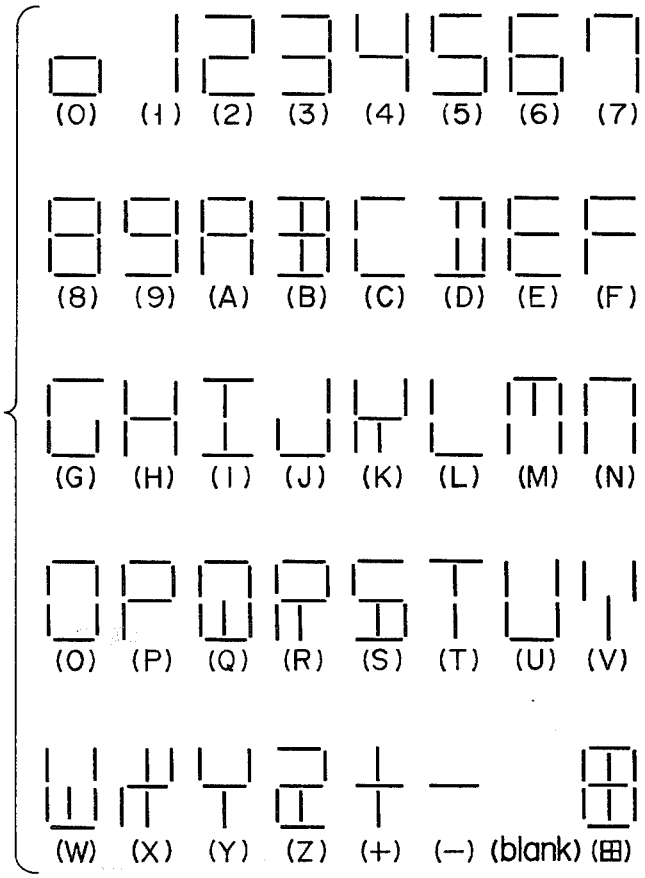
FIG. 2 illustrates the character patterns indicated on the display device of the invention.

With the foregoing embodiment, each digit division is formed of 9-segment LEDs, and can display $2^9=512$ forms of characters. However, let it be assumed that it is intended to display ten digits of 0 to 9, twenty six English alphabet letters of A to Z and four notations such as +, −, "blank" and , namely, forty characters, as shown in FIG. 2.

Figure 3A:
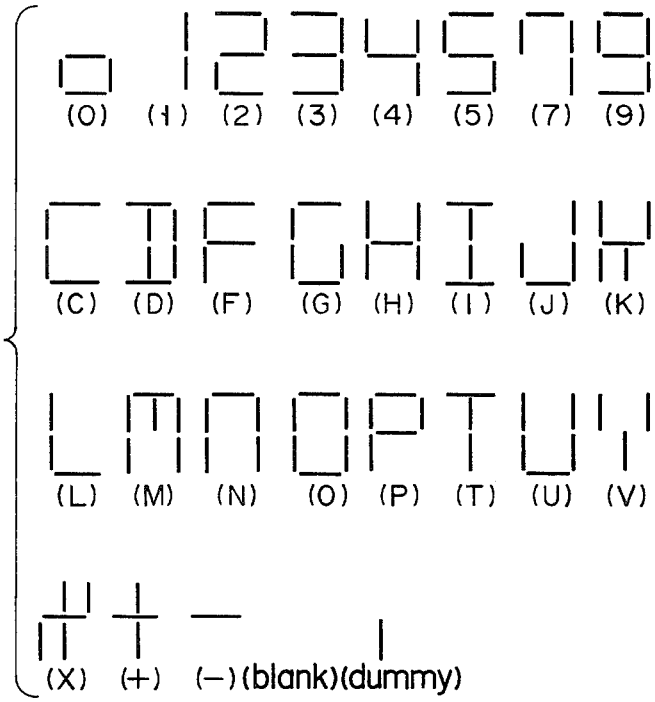
FIG. 3A shows the character patterns whose character signals are decoded by a decoder used with the display device.

The decoder 22 should be supplied with a 6-bit input signal in order to display the forty characters. However, a decoder used with a one-chip microcomputer applied for the control of a camera generally has an only 5-bit capacity. However, some of the forty characters can be respectively produced by coupling two characters. For instance, the character 6 is produced by coupling the character G to that of −, and the character 8 is formed by coupling the character of 0 to that of −. When a dummy character 1 given in the last of FIG. 3A is taken into account, in addition to the forty characters, the characters produced by coupling two characters together total twelve forms shown in FIG. 3B. For instance Q is formed by coupling 0 to the dummy 1. Therefore, the decoder 22 can well serve the purpose, if it has a capacity to decode 29 characters shown in FIG. 3A. In other words, the decoder 22 has only to be provided with a 5-bit capacity. The display device of this invention is so arranged that the characters of FIG. 3A themselves are displayed in combination with the blank character.

Figure 3B:
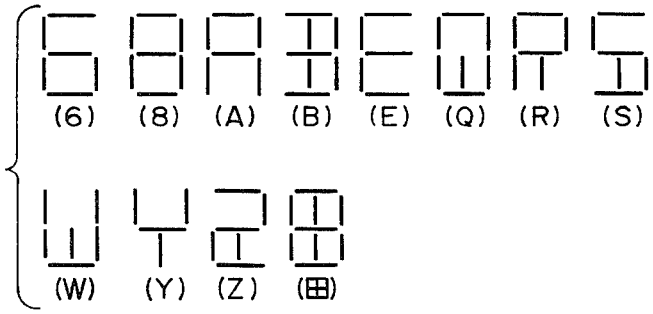
FIG. 3B indicates the character patterns whose character signals are not decoded by the decoder.

With the display device of this invention, therefore, the ROM 18 stores 29 character signals shown in FIG. 3A. First and second character component signals are read out of the addresses in accordance with the character signals specified by the keyboard 10. The two readout character component signals are stored in the RAM 20. When any of the characters shown in FIG. 3A are specified, then the corresponding character signal and blank signal are stored in the RAM 20. When any of the characters indicated in FIG. 3B is specified then, the corresponding two character component signals are stored in the RAM 20.

When the shutter is released, the first character component signals of the first to the sixth digit divisions are successively read out of the RAM 20 to be decoded. The decoded signals are supplied as segment signals to the corresponding segment electrodes of the display section 30. At this time the interface circuit 32 issues a digit division-specifying signal to the digit division electrodes of the first to the sixth digit divisions of the display section 30. Thus the display of the first character component signals is carried out throughout the first to the sixth digit divisions. Thereafter, the display of the second character component signals is carried out similarly throughout the first to the sixth digit divisions.

The above-mentioned cycle of displaying the first and second character component signals throughout the first to the sixth digit divisions is repeated. As a result, the characters initially specified by the keyboard 10 are displayed.

With the display device of this invention, one character is displayed by displaying the two character components thereof in succession, thereby making it possible to apply a decoder having a smaller capacity. Further, the full display of one character is effected by the successive two emissions of light corresponding to two character component signals, thereby well serving the purpose simply by conducting a smaller amount of current through the display section 30 each time, and consequently making it possible to use a driver having a smaller capacity.

Obviously this invention is not limited to the above-mentioned embodiment, but may be practised in various modifications. A combination of two character components is not limited to the aforementioned process. In other words, the process of combining two character components may be varied, provided the same display segment is not represented by the two character component signals. The first and second characters may be displayed for each digit division.

What we claim is:

1. A segmented display device comprising:

a segmented display section;

key input means for generating a character signal corresponding to a key operated;

means for converting the character signal to at least two character component signals respectively representing character components, the character components being representative of a character as a whole without any portions thereof overlapping each other;

decoder means having a capacity smaller than the number of characters which can be designated by said key input means, connected to said segmented display section; and control means for sequentially supplying said at least two character component signals to said decoder means.

2. A device according to claim 1, wherein said converting means is formed of a read only memory which stores character component signals corresponding to only those of all the characters to be displayed at the segmented display section, from which at least two character component signals corresponding to the output character signal from said key input means are read out.

3. A device according to claim 2, wherein the segmented display section is formed of a plurality of digit divisions which are each provided with a plurality of segment display elements, and the respective segments of each digit are sequentially lit by said at least two character component signals from the read only memory.

4. A device according to claim 2, wherein the segmented display section is formed of a plurality of digit divisions each provided with a plurality of segment display elements, and the corresponding segments of the respective digits are sequentially lit by said at least two character component signals from the read only memory.

* * * * *